US007367558B2

(12) United States Patent
Förch et al.

(10) Patent No.: US 7,367,558 B2
(45) Date of Patent: May 6, 2008

(54) MACHINE FOR PROCESSING PRINTING MATERIAL SHEETS

(75) Inventors: Peter Förch, Neustadt (DE); Markus Möhringer, Weinheim (DE); Paul Nicola, Heidelberg (DE); Marius Stelter, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 341 days.

(21) Appl. No.: 10/950,326

(22) Filed: Sep. 24, 2004

(65) Prior Publication Data

US 2005/0067774 A1 Mar. 31, 2005

(30) Foreign Application Priority Data

Sep. 26, 2003 (DE) ..... 103 44 714

(51) Int. Cl.
*B65H 29/04* (2006.01)

(52) U.S. Cl. ..... 271/206; 271/204; 198/604; 198/620

(58) Field of Classification Search ..... 271/204, 271/277, 205, 176, 199, 82, 85; 294/907; 901/46; 198/644, 604, 623, 810.03, 620, 198/626.3, 502.2, 502.3
See application file for complete search history.

(56) References Cited

U.S. PATENT DOCUMENTS 3,413,732 A 12/1968 Koch et al.
5,251,891 A 10/1993 Blaser et al.
5,431,386 A 7/1995 Blaser
5,445,372 A * 8/1995 Blaser et al. ..... 271/309
5,749,455 A * 5/1998 Mizuta et al. ..... 198/626.5
6,201,389 B1 * 3/2001 Apel et al. ..... 324/207.2
6,497,320 B2 * 12/2002 Kondo et al. ..... 198/502.3
6,666,375 B1 * 12/2003 Harriman et al. ..... 235/454

FOREIGN PATENT DOCUMENTS

DE 1 260 482 2/1968
DE 42 01 480 A1 7/1993
DE 42 18 421 A1 12/1993
DE 196 34 910 A1 3/1998
GB 2 168 687 A 6/1986

* cited by examiner

*Primary Examiner*—Patrick Mackey
*Assistant Examiner*—Jeremy R Severson
(74) *Attorney, Agent, or Firm*—Laurence A. Greenberg; Werner H. Stemer; Ralph E. Locher

(57) ABSTRACT

A machine for processing printing material sheets has a signal generator for position monitoring and a sheet delivery. The sheet delivery has a first conveying device, for example with a holding crossmember, for leading sheet ends and a second conveying device, for example with a holding crossmember, for trailing sheet ends. The signal generator is disposed in the sheet delivery.

12 Claims, 7 Drawing Sheets

MACHINE FOR PROCESSING PRINTING MATERIAL SHEETS

BACKGROUND OF THE INVENTION

1. Field of the Invention

The present invention relates to a machine for processing printing material sheets. The machine has a signal generator for position monitoring and a sheet delivery, which includes a first conveying device for leading sheet ends and a second conveying device for trailing sheet ends.

In a machine of this type, each printing material sheet is held fixedly during transport at its leading sheet end by means of the first conveying device and, at the same time, at its trailing sheet end by means of the second conveying device. The conveying devices can be, for example, chain conveyors.

German published patent application DE 42 18 421 A1 and corresponding U.S. Pat. No. 5,431,386 describe a printing press having a sheet delivery, whose chain conveyors are driven synchronously by a separate drive. The separate drive is controlled via a signal generator which is probably configured as a rotary encoder and whose location of installation is not described in greater detail in the above-mentioned document.

It is known to those of skill in the pertinent art that printing units of printing presses are equipped with rotary encoders.

2. Summary of the Invention

It is accordingly an object of the invention to provide a machine for processing printing material sheets which overcomes the above-mentioned disadvantages of the heretofore-known devices and methods of this general type and which is enabled to ensure particularly high monitoring accuracy of the signal generator.

With the foregoing and other objects in view there is provided, in accordance with the invention, a sheet-processing machine for processing printing material sheets having leading sheet ends and trailing sheet ends, the machine comprising:

a sheet delivery having a first conveying device for the leading sheet ends and a second conveying device for the trailing sheet ends; and a signal generator for position monitoring disposed in said sheet delivery.

In other words, the machine according to the invention for processing printing material sheets has a signal generator for position monitoring, and it has a sheet delivery with a first conveying device for leading sheet ends and a second conveying device for trailing sheet ends. The machine is distinguished by the fact that the signal generator is disposed in the sheet delivery.

This results in the advantage that the unavoidable play between the sheet delivery and the rest of the machine has no influence on the accuracy of the monitoring performed by way of the signal generator. In the case of a design of the machine as a printing press with a printing unit and the sheet delivery, for example, the monitoring result of the signal generator remains unimpaired by the tooth play (gear play) of gear wheels arranged between the printing unit and the sheet delivery.

According to one development, a further signal generator for position monitoring is arranged in the sheet delivery. The signal generators can be linked to one another, in order to form together a safety device for monitoring the synchronous running of the conveying devices, or a measuring device for monitoring the adjustment of the format of one of the conveying devices. The signal generator and/or the further signal generator can be a rotary encoder and can have a marking and a sensor for detecting the marking. With regard to changing the format, it is advantageous for one of the conveying devices to be mounted displaceably relative to the other one. The machine according to the invention is preferably a printing press.

Other features which are considered as characteristic for the invention are set forth in the appended claims.

Although the invention is illustrated and described herein as embodied in a machine for processing printing material sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
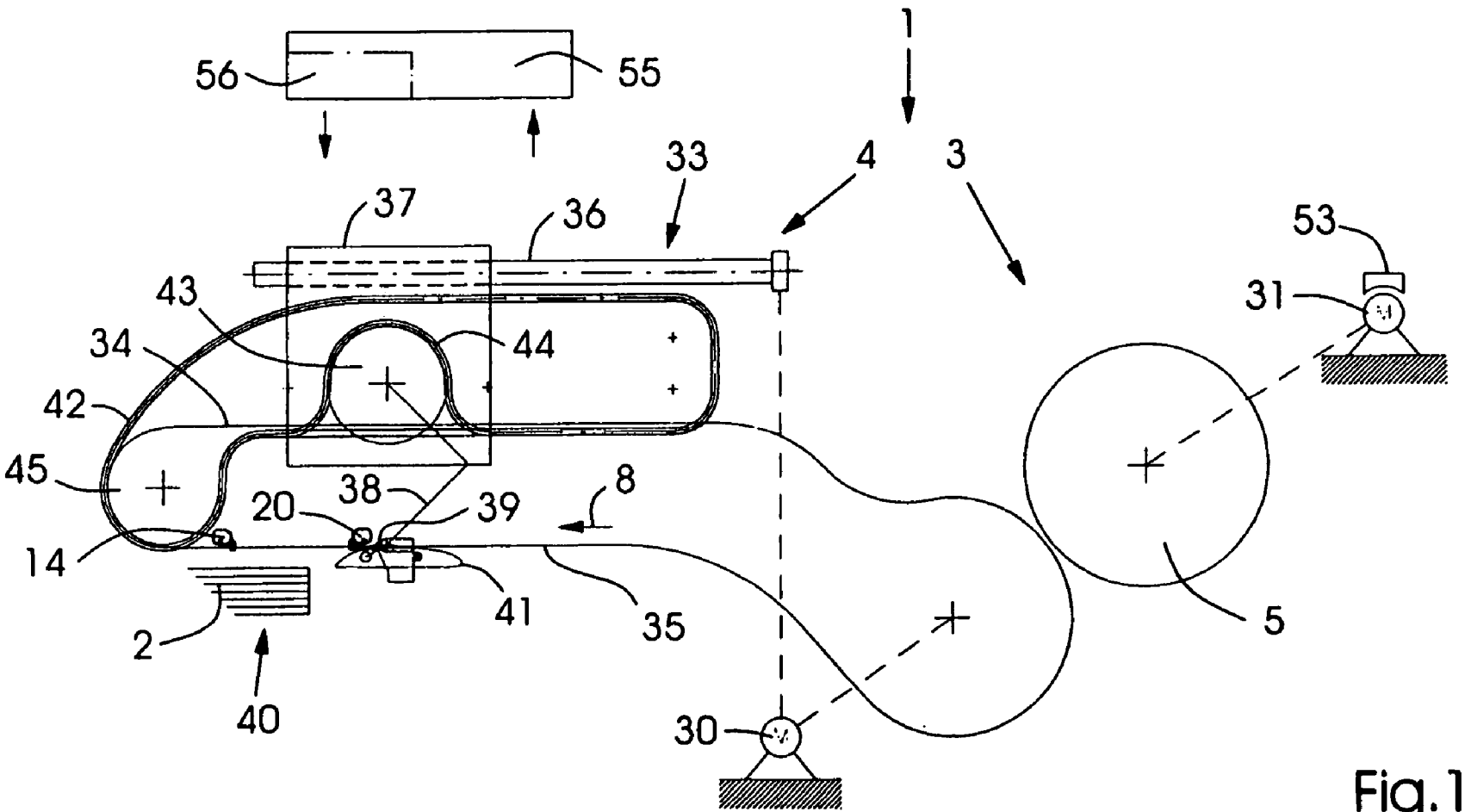
FIG. 1 is a diagrammatic side view of a first exemplary embodiment, in which the signal generators are rotary encoders.
Figure 2:
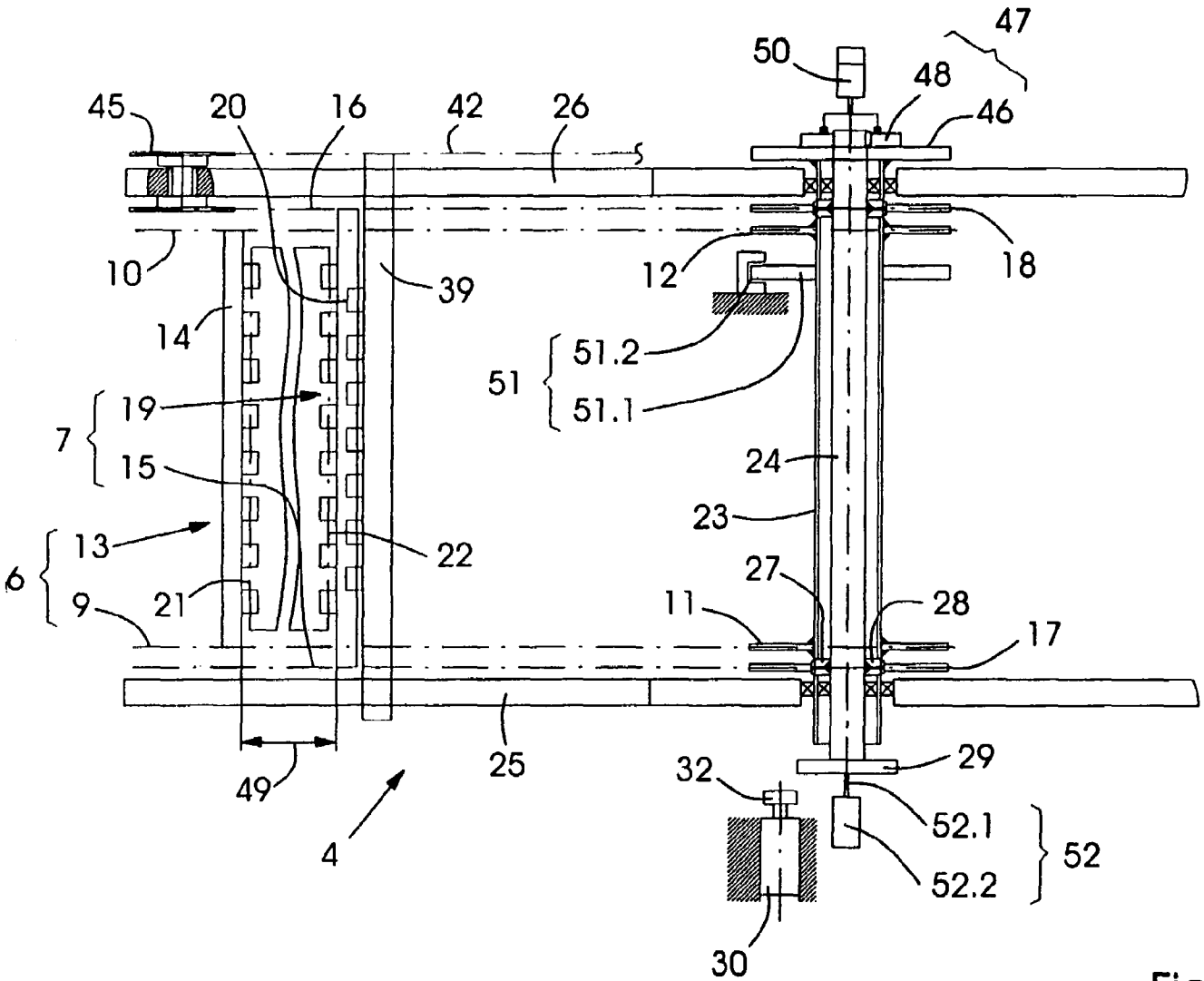
FIG. 2 is a plan view of the first exemplary embodiment of the invention.
Figure 3:
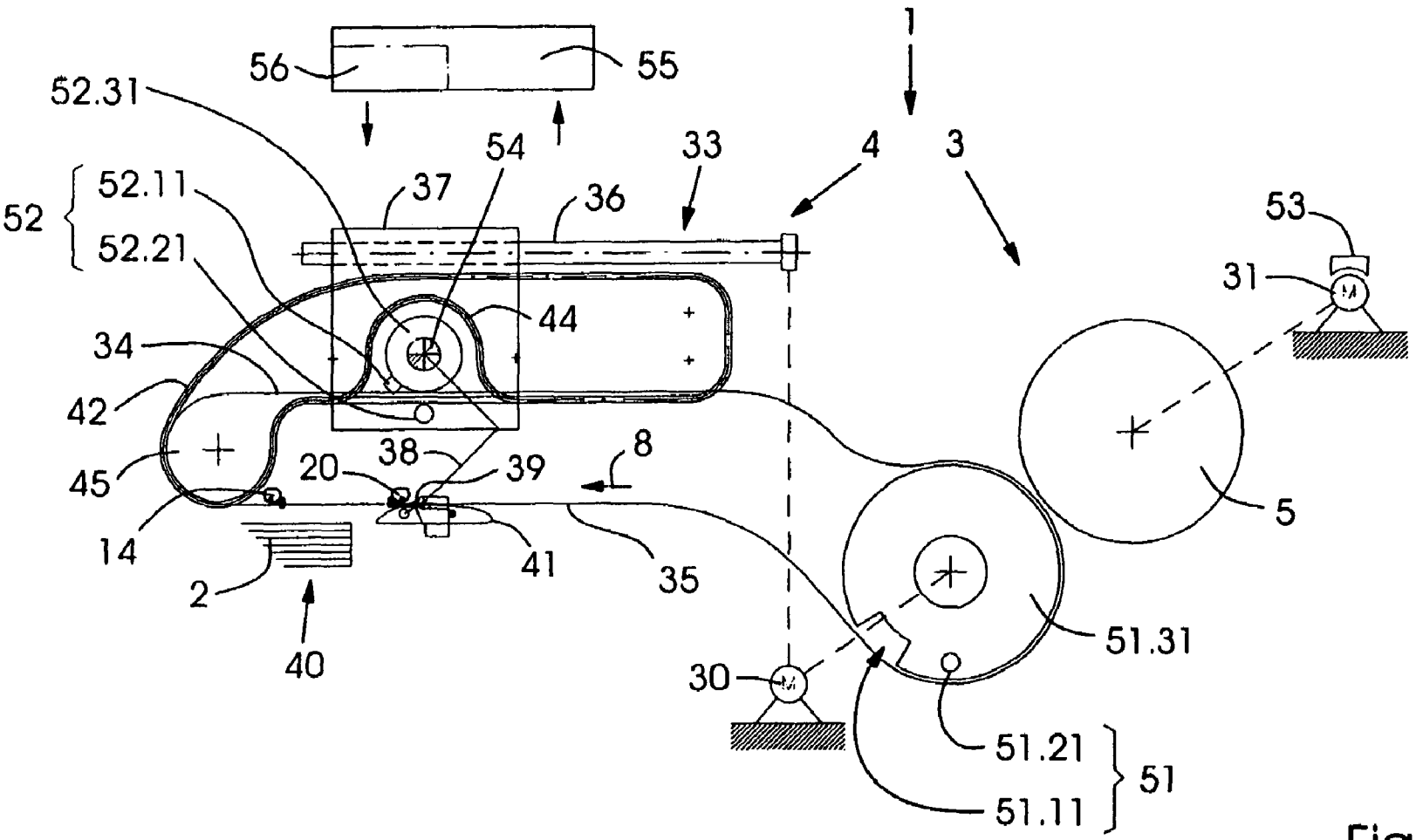
FIG. 3 is a diagrammatic side view of a second exemplary embodiment, in which the signal generators are each a marking/sensor pair.
Figure 4:
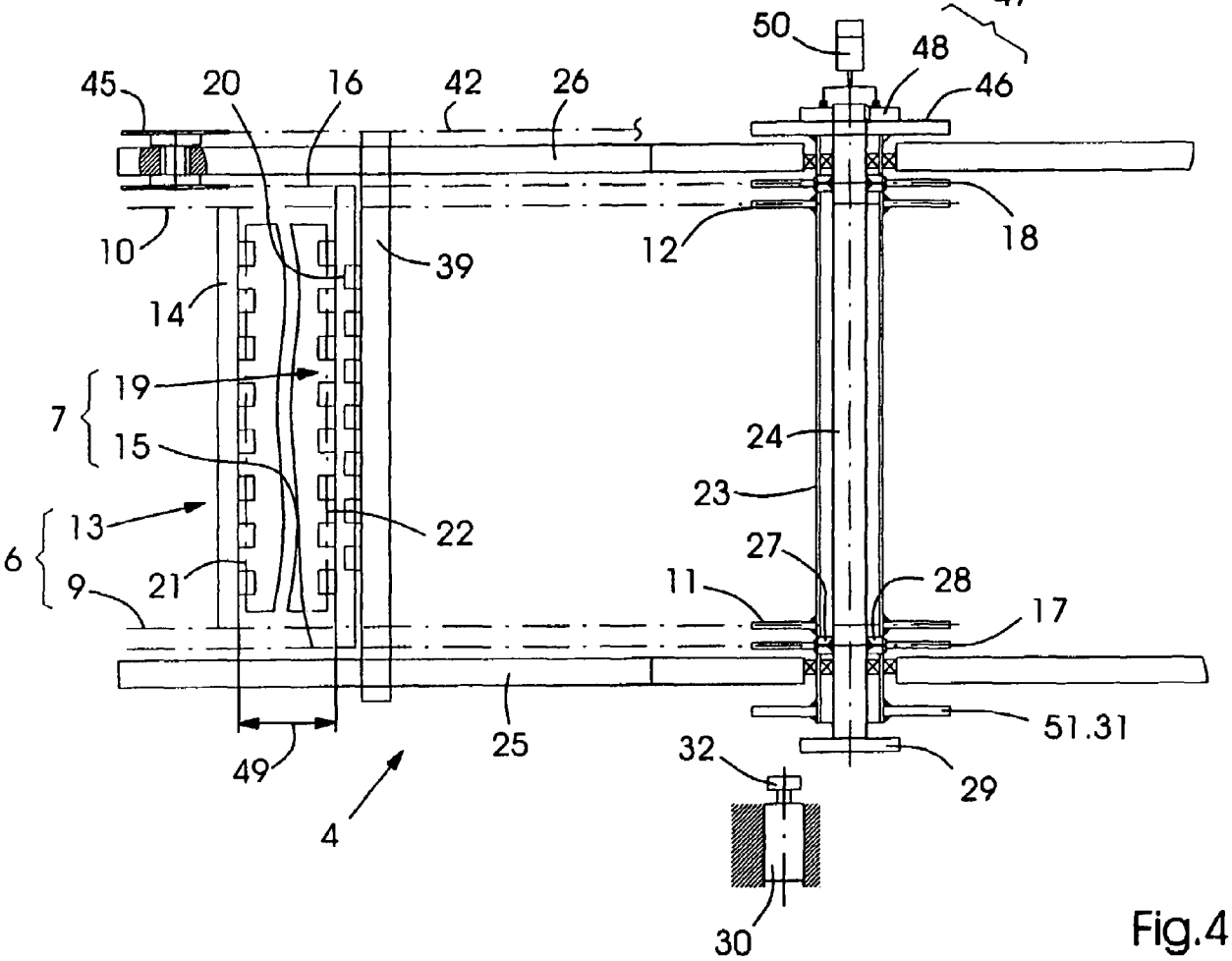
FIG. 4 is a plan view of the second exemplary embodiment of the invention.

Referring now to the figures of the drawing in detail, the two exemplary embodiments have the following common features: a machine 1 for processing printing material sheets 2 is shown both in FIGS. 1 and 2 (first exemplary embodiment) and in FIGS. 3 and 4 (second exemplary embodiment). The machine 1 is a printing press and comprises at least one printing unit 3 and a sheet delivery 4. The printing unit 3 comprises an impression cylinder 5 and can be an offset printing unit or a flexographic printing unit used, for example, for varnishing. The sheet delivery 4 comprises a first conveying device 6 and a second conveying device 7. The conveying devices 6, 7 are chain conveyors and circulate in a circulating direction 8.

The first conveying device 6 comprises endless chains 9, 10, chain sprockets 11, 12 for driving and deflecting the chains 9, 10, and a holding crossmember set 13 fastened to the chains 9, 10. The holding crossmember set 13 is composed of a plurality of holding crossmembers which are equidistantly distributed along the chains 9, 10 and of which, however, only one single holding crossmember 14 is shown in the drawing for reasons of clarity. The second conveying device 7 comprises endless chains 15, 16, chain sprockets 17, 18 for driving and deflecting the chains 15, 16, and a holding crossmember set 19 fastened to said chains 15, 16. Said holding crossmember set 19 is composed of a plurality of holding crossmembers which are arranged equally distributed along the chains 15, 16 and of which, however, only one single holding crossmember 20 is shown in the drawing for reasons of clarity. The holding crossmembers of the first conveying device 6 form, together with the holding crossmembers of the second conveying device 7, pairs of holding crossmembers, each of which holds in each case one of the printing material sheets 2 firmly at its leading sheet end 21, as seen in the circulating direction 8, and, at the same time, at its trailing sheet end 22. In FIGS. 2 and 4, using the example of the pair of holding crossmembers formed by the holding crossmembers 14, 20, the sheet ends 21, 22 which are held firmly are indicated by phantom lines. The holding crossmembers of the first conveying device 6 are gripper bars and hold the printing material sheets 2 firmly by clamping force. The holding crossmembers of the second conveying device 7 are also gripper bars in which the printing material sheets 2 are held in a clamped manner.

A first shaft 23 bears the chain sprockets 11, 12 of the first conveying device 6 which are seated fixedly on said shaft 23, and is configured as a hollow shaft. A second shaft 24 bears the chain sprockets 17, 18 of the second conveying device 7 which are seated fixedly on said shaft 24, and extends through the hollow, first shaft 23. The first shaft 23 and its chain sprockets 11, 12 are arranged coaxially with respect to the second shaft 24 and its chain sprockets 17, 18. The shafts 23, 24 are mounted rotatably in side walls 25, 26.

Each of the chain sprockets 17, 18 consists of an annular gear or gear ring, which is disposed outside the first shaft 23 and is provided with diametrical support spokes 27, 28. The support spokes 27, 28 protrude through slots made in the first shaft 23 into the first shaft 23. The respective annular gear is fastened to the inner, second shaft 24 via the support spokes 27, 28. When the second shaft 24 and therefore the chain sprockets 17, 18 are rotated relative to the first shaft 23 and therefore to the chain sprockets 11, 12 for the purpose of adjusting the format (which will be described later in detail), the support spokes 27, 28 slide along said slots, whose slot length extending in the circumferential direction of the first shaft 23 is dimensioned in correlation with the format difference existing between a minimum possible format length and a maximum possible format length for the printing material sheets 2.

A first gear wheel 29 is arranged on the second shaft 24 on the side of the side wall 25 remote from the chain sprockets 11, 17, via which gear wheel 29 it is possible to drive the second shaft 24 rotationally during format adjustment by an electric motor 30. The first motor 30 is an actuating drive which [lacuna] by an electric second motor 31 which is the main drive of the machine 1 and which, during printing operation, drives not only the printing unit 3 including the rotation of the impression cylinder 5 but also the conveying devices 6, 7 and their movement in the circulating direction 8. The first motor 30 can optionally be coupled to the second shaft 24 and uncoupled from the second shaft 24, in that a second gear wheel 32 which is seated on the motor shaft of the first motor 30 is displaced axially and as a result is brought into or out of engagement with the first gear wheel 29.

A mechanical connection of the first motor 30 to a first linkage mechanism 33 is shown diagrammatically with a broken line in FIGS. 1 and 3. The first linkage mechanism 33 is a screw mechanism having a threaded spindle 36 which extends longitudinally in parallel with horizontal sections of runs 34, 35 of the chains 9, 10, 15, 16. When the format is adjusted or changed, the first linkage mechanism 33 serves to displace an auxiliary frame 37 and a second linkage mechanism 38 mounted therein relative to the first conveying device 6, which displacement takes place synchronously with the sheet format-dependent displacement of the second conveying device 7 relative to the first conveying device 6. Depending on the rotational direction of the threaded spindle 36 which is screwed into an internal thread of the auxiliary frame 37, the auxiliary frame 37 and the second linkage mechanism, as well as an aftergripper 39 which is driven via the second linkage mechanism 38 and is fastened to the latter, are displaced (horizontally) either away from a delivery stack 40 and toward the printing unit 3 or in the opposite direction, that is to say toward the delivery stack 40.

The aftergripper 39 accepts the trailing sheet end 22 of each printing material sheet 2 from the respective holding crossmember of the second conveying device 7 and subsequently guides the sheet end to the delivery stack 40. During printing or machine operation, the aftergripper 39, which is likewise configured as a holding crossmember (gripper bar) which holds the printing material sheet 2 firmly by clamping force, is moved along a closed movement path 41.

The second linkage mechanism 38 comprises an endless drawing means 42 in the form of a chain and gears meshing with the drawing means 42, among them a first gear 43 which is shown in the drawing of FIG. 1 and is not shown in the drawing of FIG. 3 for reasons of clarity although it is present there. The drawing means 42 wraps around the first gear 43 with formation of a loop 44, in such a way that the first gear 43 is in contact with the drawing means 42 on the outside of the latter. The movement of the aftergripper 39 along the movement path 41 is driven by the second motor 31 via the chain 16, the drawing means 42, the first gear 43, a second gear 45 and further linkage members (not denoted in greater detail). The second gear 45 which is likewise in engagement with the drawing means 42 is rotatably mounted in the side wall 26 which belongs to a main frame of the sheet delivery 4. As a result, the drawing means 42 is arranged in a substantially stationary position and the first gear 43 which is rotatably mounted in the auxiliary frame 37 necessarily rolls on the drawing means 42 during the horizontal displacement of the auxiliary frame 37 along the threaded spindle 36, the loop 44 also being displaced along the drawing means 42 and the first gear 43 maintaining its phase relation relative to the second conveying device 7 in an unchanged state. If the first gear 43 is displaced horizontally while circulation of the drawing means 42 is interrupted, that is to say when the machine is at a standstill, then the first gear 43 maintains its rotary angle position relative to the auxiliary frame 37 during its horizontal displacement. These technical conditions ensure harmonization of the circulating position of the aftergripper 39 within its movement path 41 with the circulating position of the holding crossmembers of the second conveying device 7 within its circulating path. As a result, the aftergripper 39 is located in the correct sheet acceptance position to accept the respective printing material sheet 2 from the corresponding holding crossmember of the second conveying device 7 in each of its possible format settings which correspond with various spacings of the adjustable movement path 41 relative to the delivery stack 40.

A third gear wheel 46 and a friction clutch 47 are disposed on that side of the side walls 26 which is remote from the chain sprockets 12, 18. The third gear wheel 46 is seated fixedly on the first shaft 23 so as to rotate with it and the second shaft 24 is passed loosely through the third gear wheel 46. A plate-shaped clutch half 48 of the clutch 47 is seated axially displaceably and fixedly in terms of rotation on the second shaft 24. The third gear wheel 46 forms the other clutch half of the clutch 47 which cooperates with the clutch half 48. When said clutch 47 is closed, the shafts 23, 24 are connected fixedly to one another so as to rotate together and, as a result, the mutually synchronous running of the conveying devices 6, 7 in the circulating direction is ensured. Therefore, when the clutch 47 is closed, the phase relation of the second conveying device 7 relative to the first conveying device 6 cannot be changed in principle, unless the clutch 47 slips as a result of a defect. When the clutch 47 is open, the phase relation of the second conveying device 7 relative to the first conveying device 6 can be changed, in that the second shaft 24 is rotated relative to the first shaft 23 by means of the first motor 30 and the chains 15, 16 are displaced relative to the chains 9, 10 in the process. This rotation and chain displacement adjusts the holding crossmembers of the second conveying device 7, depending on the rotational direction of the second shaft 24, into a closer or more distant sheet format-correlated spacing 49 relative to the holding crossmembers of the first conveying device 6. The clutch 47 is assigned an actuating drive 50 which, when the clutch 47 is closed by spring force, presses its clutch half 48 against the third gear wheel 46 and, when the clutch 47 is opened by the action of fluid, pulls the clutch half 48 away from the third gear wheel 46 again. The actuating drive 50 is a pneumatic or hydraulic operating cylinder which is combined with a spring. Excessive slip of the clutch 47 would result in an undesirable, excessive change in the spacing 49. Problems with the transport of the printing material sheets 2 could result from this undesirable change in the spacing.

In order to avoid a machine malfunction of this type, to detect the clutch slip at an early stage and to stop the machine running immediately in the event of an accident or malfunction, the sheet delivery 4 is equipped with a first signal generator 51 and a second signal generator 52. The machine running is stopped by a brake 53 assigned to the second motor 31. The signal generators 51, 52 are linked to one another via an electronic control device 55 which contains a comparator 56. The control device 55 actuates the brake 53 and the motors 30, 31. The first signal generator 51 is assigned directly to the first shaft 23. The two exemplary embodiments differ from one another with regard to the type of the signal generators 51, 52 and the installation site of the second signal generator 52, for which reason they will be described further in the following text separately from one another.

Figure 5:
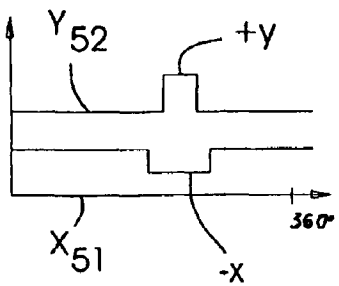
FIG. 5 is a diagram which is related to the second exemplary embodiment and which shows signal amplitudes of the signal generators as a function of the phase relation of the machine.

In the exemplary embodiment shown in FIGS. 3 to 5, the two signal generators together form a safety device for monitoring the synchronous running of the conveying devices 6, 7. Here, the second signal generator 52 is assigned to the first linkage mechanism 33 and is therefore arranged on the auxiliary frame 37, and each of the two signal generators 51, 52 comprises a marking 51.11 and 52.11, respectively, and a sensor 51.21 and 52.21, respectively, which is oriented at a circulating path of the respective marking 51.11 and 52.11 for detecting said respective marking 51.11 and 52.11.

The marking 51.11 is a cutout or gap on the circumferential side which is made in a disk 51.31 seated firmly on the first shaft 23, so that said disk 51.31 is connected without play and fixedly to the chain sprockets 11, 12 so as to rotate with them. The sensor 51.21 is fixed in a stationary manner to the main frame in such a way that, while it rotates together with the first shaft 23, the marking 51.11 is moved periodically through the target region of the sensor 51.21.

The marking 52.11 is a lug or a tab and is arranged on the circumferential side of a disk 52.31 so as to protrude. Said disk 52.31 is arranged coaxially with respect to and connected fixedly so as to rotate with the first gear 43 (cf. FIG. 1) which is likewise present in the exemplary embodiment shown in FIG. 3 but is not shown in the drawing. The disk 52.31 and the first gear 43 are seated firmly on a common connecting shaft 54, with the result that, while it rotates together with the connecting shaft 54, the marking 52.11 is moved periodically through the target region of the sensor 52.21. Although there is a small amount of play between the chain sprockets 17, 18 of the second conveying device 7 and the disk 52.31, this play is negligibly small.

The sensors 51.21, 52.21 are sensors which operate without contact or optically. Each time that the marking 51.11 passes the sensor 51.21, a signal $X_{51}$ (cf. FIG. 5) with an amplitude "−x" is generated by the latter. Each time that the marking 52.11 passes the sensor 52.21, a signal $Y_{52}$ with an amplitude "+y" is generated by the latter. As long as the clutch 47 does not slip and the two conveying devices 6, 7 accordingly run synchronously with respect to one another, the two signals $X_{51}$, $Y_{52}$ occur substantially simultaneously and the two amplitudes "−x", "+y" lie substantially centrically or congruently with respect to one another. The continuously operating comparator 56 recognizes each drifting apart of the two amplitudes "−x", "+y" as a result of any clutch slip and the control device 55 automatically interrupts the operation of the sheet delivery 4 by actuating the brake 53, as soon as an amplitude eccentricity which has been supplied to the comparator 56 as limiting value is exceeded as a result of the two amplitudes drifting apart.

During each change in the spacing 49 intended for the purpose of changing the format, the chain sprockets 17, 18 are rotated relative to the chain sprockets 11, 12 by means of the first motor 30 and the second linkage mechanism 38 and the aftergripper 39 fastened thereto are simultaneously displaced linearly. The coupling (explained further above) of the chain sprocket rotation to the linear displacement via the gear 43 (cf. FIG. 1) and the drawing means 42 ensures in an automated manner that the phase relation of the marking 52.21 relative to the marking 51.11 remains unchanged during this change in format.

In the other exemplary embodiment shown in FIGS. 1 and 2, the two signal generators 51, 52 are configured as rotary encoders and are arranged substantially coaxially with respect to one another, the first signal generator 51 being assigned to the first shaft 23 and the second signal generator 52 being assigned to the second shaft 24. In this exemplary embodiment, the two signal generators 51, 52 together form both a safety device for monitoring the synchronous running of the conveying devices 6, 7 and also a measuring device for monitoring the adjustment of the format of one of the conveying devices 6, 7. Each of the signal generators 51, 52 comprises a rotor 51.1 and 52.1, respectively, and a stator 51.2 and 52.2, respectively, arranged fixedly on the frame. The rotor 51.1 of the first signal generator 51 is attached to the first shaft 23 and the rotor 52.1 of the second signal generator 52 is attached to the second shaft 24. The two signal generators 51, 52 are what are known as incremental rotary encoders. An incremental rotary encoder of this type generates what is known as a zero pulse per revolution of its rotor and has two tracks which are arranged offset by 90 degrees with respect to one another and each generate a high number of pulses per revolution of the rotor. Accordingly, it is possible for the corresponding signal generator 51, 52 to detect a reversal of the rotational direction of its rotor 51.1 and 52.1, respectively.

The two signal generators 51, 52 and rotors 51.1 and 52.1, respectively, are identical to one another with regard to their number of increments and therefore the number of produced pulses. The two signal generators 51, 52 are calibrated in such a way that, in the event of a sheet format length of zero millimeters and a corresponding spacing 49, the two zero pulses of the signal generators 51, 52 are generated simultaneously and are congruent with respect to one another. If the second shaft 24 and, together with it, the rotor 52.1 are rotated relative to the first shaft 23 or to the rotor 52.2 in the event of a format adjustment in which said spacing 49 is increased, then in this case the pulses generated by the increments of the signal generators 51, 52 or only of the signal generator 52 are counted in the control apparatus 55. The evaluation of the rotational direction or directions of the rotors is also taken into consideration in this pulse count. By adding or subtracting the two pulse numbers from the signal generators to or from one another, the currently set sheet format (actual value) is determined and displayed in the control device 55 during the format adjustment, and, proceeding from this, the first motor 30 can be regulated correspondingly, with the result that the latter sets the predefined intended format or the corresponding spacing 49.

As this format adjustment preferably takes place during machine downtime in which the first shaft 23 does not rotate, it is not necessarily required to count the pulses from the first signal generator 51 to determine and adjust the format, and it is sufficient to count the pulses of the second signal generator 52 only. Therefore, according to a modification (not shown) of the machine shown in FIG. 2, it is possible to configure the first signal generator 51 as a marking/sensor combination or exactly as in FIG. 4 instead of as a rotary encoder. Proceeding from the reference zero pulse (cf. FIG. 5: "–x") of this marking/sensor combination, the second signal generator 52 which remains in this modification as a rotary encoder can be used as previously to count the pulses.

In the embodiment shown in FIG. 2, the number of pulses produced by the increments between the zero pulse of the first signal generator and the zero pulse of the second signal generator 52 is counted by the control device 55 for the purpose of monitoring the correct engagement of the clutch 47 while the machine is running. The pulse count is started by the zero pulse of the first signal generator 51 and ended by the zero pulse of the second signal generator 52. There is a known correlation between the number of the pulses counted between said two zero pulses and the set sheet format or spacing 49. A setpoint pulse number which is stored in the control device 55 corresponds to the set sheet format, the comparator 56 comparing the actual pulse number counted between the zero pulses with said setpoint pulse number. If this actual pulse number and therefore the spacing 49 change while the machine is running or if the actual pulse number deviates excessively from the setpoint pulse number while the machine is running, then this is an indicator for (excessive) slippage of the clutch 47. Proceeding from this indicator, the control device 55 sends a stop signal to the second motor 31 and the control device 55 brakes the machine 1 by means of the brake 53. Continuous monitoring of the clutch 47 is therefore ensured, in the course of which a decision is made by the control device 55 during each machine revolution as to whether the clutch 47 is slipping or not and whether the machine 1 is to be stopped or not.

Figure 6:
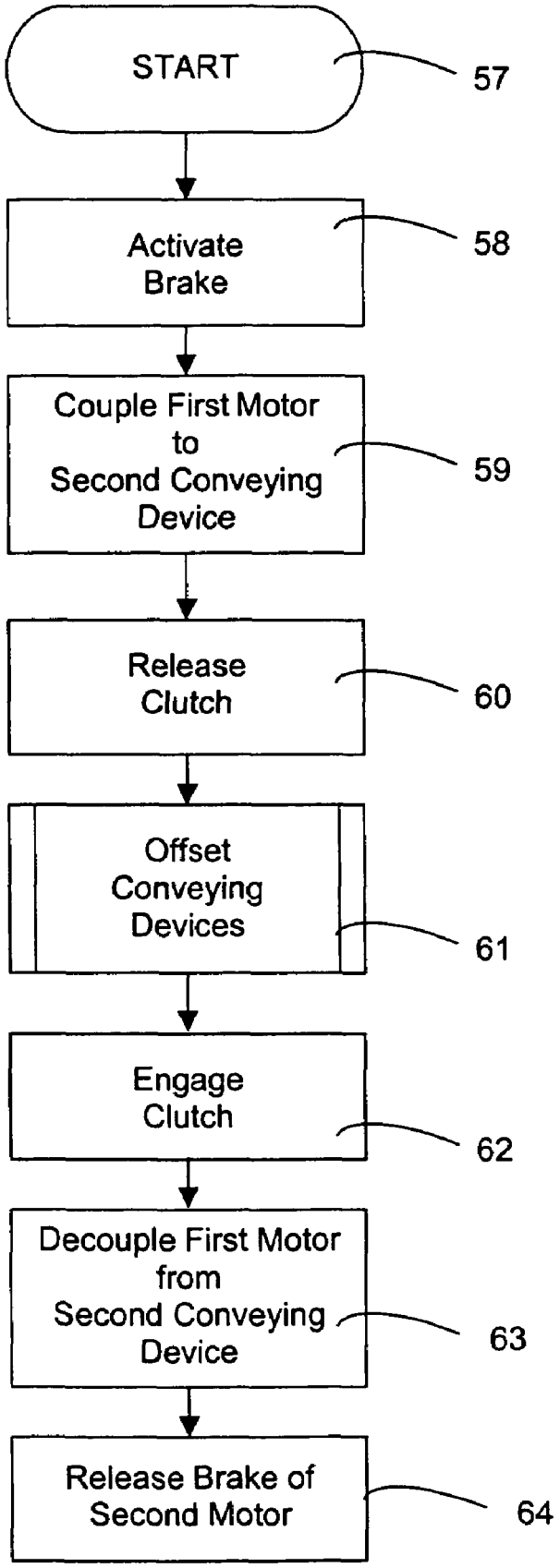
FIG. 6 is a flowchart of a program for adjusting the format of the sheet delivery in the first exemplary embodiment.
Figure 7:
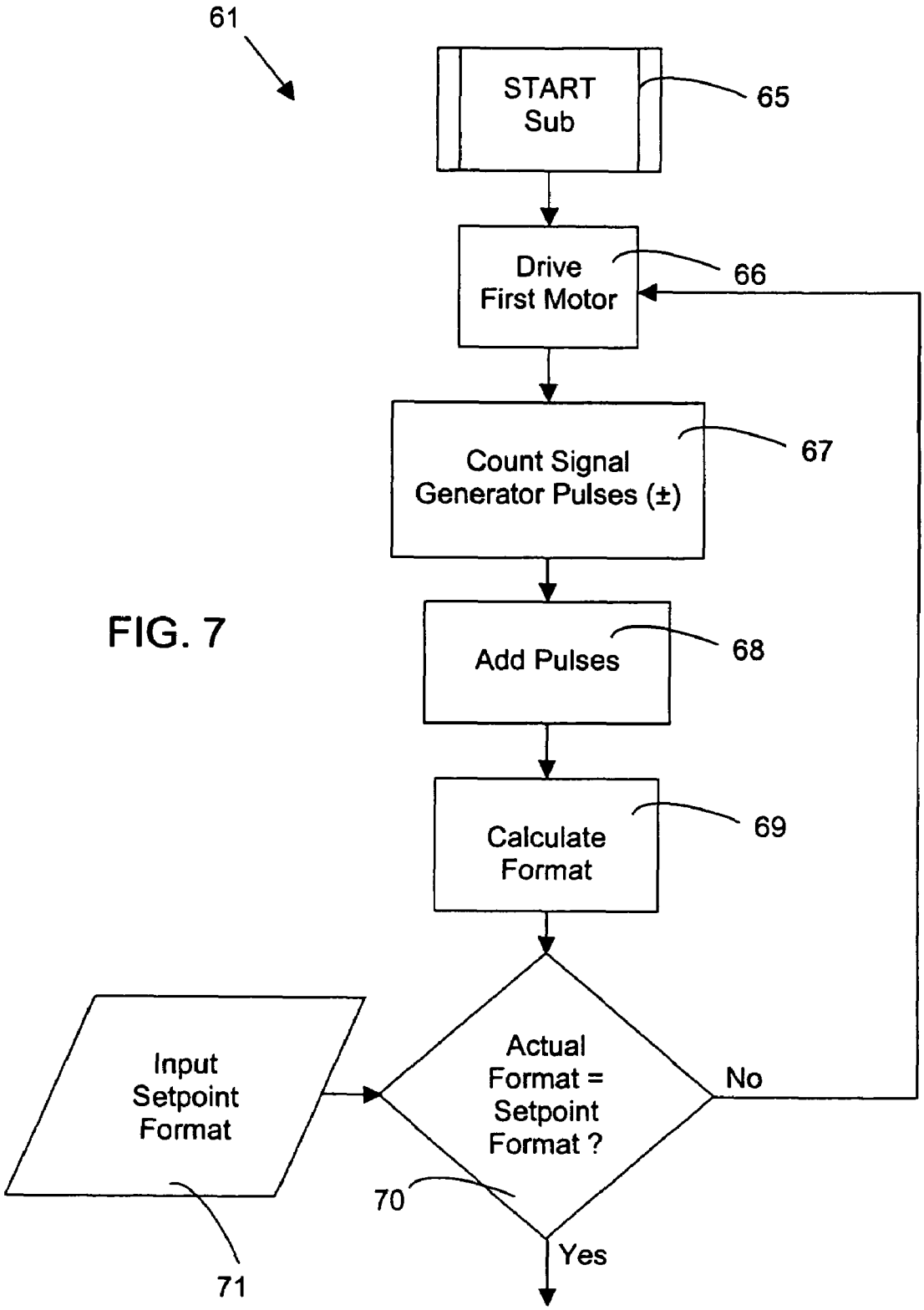
FIG. 7 is a flowchart of a subprogram of the program in FIG. 6.
Figure 8:
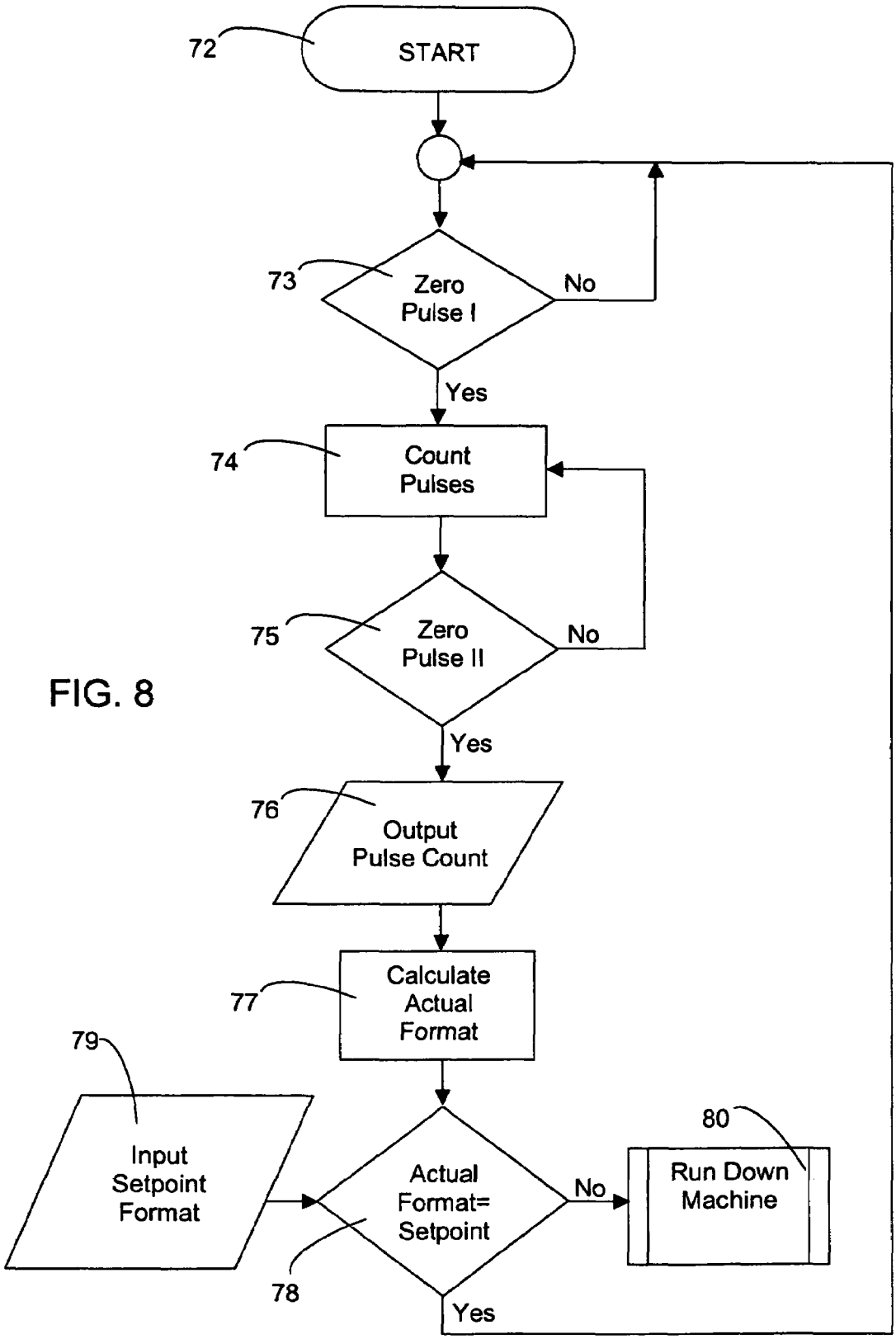
FIG. 8 is a flow chart representing a program for monitoring the synchronous running of the conveying devices in the first exemplary embodiment.

The program which is running in the exemplary embodiment shown in FIGS. 1 and 2 in the control device 55 during the format change and the monitoring of the clutch and synchronous running is illustrated in the flowcharts of FIGS. 6 to 8 using the corresponding program steps or stages 57 to 80.

In a first step 57, the format change is started, in which, for example, the sheet length which is set in the machine is to be changed from 630 mm to 720 mm. In the step 58, the brake 53 is activated and as a result the second motor 31 is inhibited. In the step 59, the first motor 30 is coupled to the second conveying device 7. In the step 60, the clamping action of the clutch 47 is released. In the step 61, the first motor 30 is rotated until the second conveying device 7 has attained the required difference distance of 90 mm (720 mm−630 mm=90 mm) relative to the first conveying device 6. In the step 62, the clutch 47 is clamped again and, in the step 63, the first motor 30 is uncoupled from the second conveying device 7. In the step 64, the brake 53 of the second motor 31 is finally released again.

In FIG. 7, the step 61 is shown in detail as a subprogram: the steps 65 to 71 are therefore partial steps of the program step 61. The subprogram shown in FIG. 7 is called up with the step 65. The step 66 comprises rotating the first motor 30. The step 67 comprises counting the pulses of the first signal generator 51 and counting the pulses of the second signal generator 52 in each case with recognition as to whether the respective rotor 51.1 or 52.1 is rotating in the positive or negative rotational direction during pulse generation. In step 68, the signed pulse numbers which have been obtained in the step 67 are added to one another, in order to obtain the number of what are called actual pulses as the result of this addition. In the step 69, the actual format which is currently present in the machine 61 is calculated, in that the dimensional value of the circumference of the signal generator is multiplied by a quotient. The quotient results in the step 69 by dividing the number of actual pulses determined in the step 68 by the total number of pulses. In the step 70, the actual format is compared with a setpoint format which has been input into the control device 55 in the step 71. If the result of the comparison in the step 70 of the actual format and the setpoint format is a difference or inequality, the program jumps back from the step 70 to the step 66 and the program loop is run through again. If, instead of this, format equality is detected, machine operation is permitted and the program jumps to the step 72.

FIG. 8 shows that the start for monitoring the clamping action of the clutch 47 while the machine is running and therefore for monitoring the synchronous running of the conveying devices 6, 7 or ensuring the spacing 49 takes place in the step 72. The program part shown in FIG. 8 is run through during each revolution of the shafts 23, 24 and therefore of the signal generators 51, 52. An interrogation is performed in the step 73 as to whether the signal generator 51 has already generated its zero pulse during the revolution or whether the signal generator 51 has already signaled the zero pulse to the control device 55. The step 73 is run through repeatedly until the signal generator 51 has signaled the zero pulse. When this zero pulse has been signaled, a pulse count performed in the step 74 is started, in which the pulses caused by the increments of the first signal generator 51 or by the increments of the second signal generator 52 are counted. The pulses are counted until the pulse count is terminated in the step 75 by the generation of the zero pulse of the second signal generator 52. As long as the second signal generator 52 has not yet signaled its zero pulse to the control device 55, the count is continued by the program jumping from the step 75 back to the step 74. In step 76, the number of pulses counted in the step 74 between the two zero pulses is output. This number is called the actual pulses. In the step 77, the actual format currently present in the sheet delivery 4 is calculated, in that the circumferential length of the signal generator used in the step 74 is multiplied by a quotient which is calculated by dividing the actual pulses calculated in the step 76 by the total number of increments or pulses. In the step 78, the actual format calculated in the step 77 is compared with a setpoint format input in the step 79. If the result of said comparison is that the two formats are identical, this means that the clutch 47 has not slipped during the preceding machine revolution and the spacing 49 has been maintained during said machine revolution, and the program then jumps back to step 73, in order to run through the steps 73 to 79 again for each of the subsequent machine revolutions. If, instead, the result of the comparison in step 78 is that the actual format deviates from the setpoint format, the control device 55 allows the machine 1 to "run down" by appropriate actuation in step 80 of the second motor 31 and by appropriate actuation of the brake 53.

The decisive advantage of the exemplary embodiment shown in FIGS. 3 to 5 is that it can be implemented in practice very inexpensively.

The advantage of the other exemplary embodiment shown in FIGS. 1 and 2 is that positional monitoring of the position of the second conveying device 7 relative to the first conveying device 6 can be performed here with the same signal generators 51, 52, not only with regard to the synchronous running of the second conveying device 7 but also with regard to its format change.

Finally, reference should also be made to a modification (not shown in the drawing) of the exemplary embodiment shown in FIGS. 1 and 2, in which modification the signal generators 51, 52 are not configured as the relative rotary encoders described but instead as absolute rotary encoders which sense the current angular positions of the shafts assigned to them as absolute values, with the result that, by forming the difference of the two absolute values, the set sheet format can be calculated for the purpose of format change or of detecting clutch slip.

This application claims the priority, under 35 U.S.C. § 119, of German patent application No. 103 44 714.8, filed Sep. 26, 2003; the entire disclosure of the prior application is herewith incorporated by reference.

We claim:

1. A sheet-processing machine for processing printing material sheets having leading sheet ends and trailing sheet ends, the machine comprising:

a sheet delivery having a first conveying device for the leading sheet ends and a second conveying device for the trailing sheet ends;

a clutch for connecting said first conveying device to said second conveying device; and a signal generator for position monitoring disposed in said sheet delivery, said signal generator being a first signal generator and a second signal generator, said first and second signal generators together forming a safety device for monitoring a synchronous running of said conveying devices, said safety device being configured for determining whether said conveying devices are running synchronously, and for detecting clutch slip of said clutch, said safety device having a control device determining whether or not the machine is to be stopped depending on the clutch slip.

2. The machine according to claim 1, wherein said first and second signal generators are linked to one another.

3. The machine according to claim 1, wherein each of said first and second signal generators has a marking and a sensor for detecting said marking.

4. The machine according to claim 1, wherein said first and second signal generators are rotary encoders.

5. The machine according to claim 1, wherein said first and second signal generators together form a measuring device for monitoring a format adjustment of a format of said first conveying device and said second conveying device.

6. The machine according to claim 5, wherein said first and second signal generators are rotary encoders.

7. The machine according to claim 1, wherein said signal generator has a marking and a sensor for detecting said marking.

8. The machine according to claim 1, wherein said first signal generator is a rotary encoder.

9. The machine according to claim 1, wherein said second signal generator has a marking and a sensor for detecting said marking.

10. The machine according to claim 1, wherein said second signal generator is a rotary encoder.

11. The machine according to claim 1, wherein one of said first and second conveying devices is displaceably mounted relative to the other said conveying device.

12. In combination with a printing press, the machine according to claim 1.

* * * * *